US008806762B2

(12) United States Patent
Blaauw

(10) Patent No.: US 8,806,762 B2
(45) Date of Patent: Aug. 19, 2014

(54) CUTTING ELEMENT, ELECTRIC SHAVER PROVIDED WITH A CUTTING ELEMENT

(75) Inventor: Hubert Sjoerd Blaauw, Drachten (NL)

(73) Assignee: Koninklijke Philips N.V., Eindhoven (NL)

( * ) Notice: Subject to any disclaimer, the term of this patent is extended or adjusted under 35 U.S.C. 154(b) by 806 days.

(21) Appl. No.: 12/595,249

(22) PCT Filed: Apr. 16, 2008

(86) PCT No.: PCT/IB2008/051460

§ 371 (c)(1),
(2), (4) Date: Dec. 8, 2009

(87) PCT Pub. No.: WO2008/126062

PCT Pub. Date: Oct. 23, 2008

(65) Prior Publication Data

US 2010/0139099 A1 Jun. 10, 2010

(30) Foreign Application Priority Data

Apr. 16, 2007 (EP) ..... 07106213

(51) Int. Cl.
*B26B 21/58* (2006.01)

(52) U.S. Cl.
USPC ..... 30/346.54; 30/346.51

(58) Field of Classification Search
USPC ..... 30/45, 346.51, 346.53, 346.54; 76/104.1; 148/222
See application file for complete search history.

(56) References Cited

U.S. PATENT DOCUMENTS

| | | | | |
|---|---|---|---|---|
| 4,829,854 | A | 5/1989 | Kammerling-Essmann | |
| 4,855,188 | A | 8/1989 | Garg et al. | |
| 5,857,260 | A * | 1/1999 | Yamada et al. | 30/346.51 |
| 5,906,053 | A | 5/1999 | Turner et al. | |
| 6,701,627 | B2 | 3/2004 | Korb et al. | |
| 6,763,593 | B2 | 7/2004 | Nakatsu et al. | |
| 2004/0107578 | A1 | 6/2004 | Steele et al. | |
| 2005/0120567 | A1 | 6/2005 | Okabe | |
| 2005/0160878 | A1 | 7/2005 | Wort et al. | |
| 2005/0236070 | A1 * | 10/2005 | Blaauw et al. | 148/222 |
| 2005/0241159 | A1 * | 11/2005 | Blaauw et al. | 30/346.54 |
| 2006/0000526 | A1 | 1/2006 | Yoshiyama | |
| 2006/0201001 | A1 * | 9/2006 | Teeuw et al. | 30/346.54 |
| 2009/0218011 | A1 * | 9/2009 | Blaauw et al. | 148/207 |
| 2010/0299931 | A1 * | 12/2010 | Marchev et al. | 30/48 |

FOREIGN PATENT DOCUMENTS

| | | | |
|---|---|---|---|
| EP | 0743144 | A2 | 11/1996 |
| EP | 1537963 | A1 | 6/2005 |
| GB | 2172833 | A | 10/1986 |
| WO | 03082533 | A1 | 10/2003 |
| WO | 2004013367 | A2 | 2/2004 |
| WO | 2004015159 | A2 | 2/2004 |

* cited by examiner

*Primary Examiner* — Hwei C Payer

(57) ABSTRACT

The invention relates to a cutting element (10), such as used in an electric shaver. The cutting element is made from stainless steel with a hardened surface layer (14) over at least part of its surface, and is characterized, in that the cutting end face (11) of the element comprises a, surface layer of hardened steel at least over its cutting edge (12), the rest of the end face comprising the stainless steel. The cutting element has self-sharpening and wear adjustable characteristics. The invention also relates to a method for producing the cutting element, and to an electric shaver comprising at least one cutting element according to the invention.

11 Claims, 4 Drawing Sheets

CUTTING ELEMENT, ELECTRIC SHAVER PROVIDED WITH A CUTTING ELEMENT

FIELD OF THE INVENTION

The invention relates to a cutting element, such as used in an electric shaver, which cutting element is made from stainless steel with a hardened surface layer over at least part of its surface. The invention also relates to an electric shaver provided with such a cutting element and a method for producing the cutting element.

DESCRIPTION OF THE PRIOR ART

Stainless steel cutting elements for shavers are usually mounted on, or part of a rotatable cutting member, which is confined within a cap member, provided with radially extending cap laminae. When shaving, the cutting member elements are rotated and entrain hairs which extend through the openings between the lamellae of the cap member. In this process the cutting surfaces (or running faces) of the cutter elements are in frictional contact with the cap member lamellae surfaces. This may bring about significant wear of either cutting elements or cap member lamellae, or both, depending on the relative surface hardness of the members concerned.

For this long-standing problem, it has been proposed to provide the cutting elements and/or the shaver cap lamellae with a hardened surface layer, for instance obtained by plasma nitriding. Such cutting elements are for instance known from EP 0 743 144 B1. Other known razor blades are made of special metal alloys, which have an increased hardness, such as described in U.S. Pat. No. 6,763,593 B1. These known cutter elements however suffer from the fact that their hardness is generally too high with respect to the hardness of the cap lamellae. Although such cutter elements do not extensively wear, this unbalance in hardness leads to extensive wear of the shaver cap. Particularly with an additive shaver, an electric shaver that can be used with water, and which uses an additive released during operation, not only wear of the cutter elements may be a problem, but also corrosion may occur easily. Corrosion resistance is less of an issue with conventional shavers, but because of the concept of the additive shaver the blade is in much closer contact with moisture. At present the material used for the manufacture of these cutting elements is stainless maraging steel. This is a steel type with good corrosion resistant qualities but with moderate wear resistance. To increase the hardness the material is hardened by conventional heat treatment techniques.

Steels that are very well corrosion resistant are in most cases difficult to harden by heat treatment and have poor tribological properties, with consequent inadequate wear characteristics for the use in the additive shaver mentioned above. The wear of the outer blade is not just caused by contact with the rotating blade inside the shaver head but also through the contact with the skin and hairs, which especially as stubble, can be very though.

SUMMARY OF THE INVENTION

An object of the invention is to provide cutting elements that are corrosion proof and wear resistant, and in particular may provide a good wear balance with a shaver cap.

This object is achieved by a cutting element. In particular, a cutting element is provided, which cutting element is made from stainless steel with a hardened surface layer 14 over at least part of its surface, whereby the cutting end face 11 of the element comprises a surface layer of hardened steel at least over its cutting edge, the rest of the end face comprising the stainless steel. The open running end face 11 of the cutter leg of the cutting element (or razor blade) is meant to designate the portion of the cutting element that comes into frictional contact with the shaver cap lamellae when in use. The cutting edge of the cutting end face 11 is that peripheral edge of the end face which touches the cap lamellae first when rotating. The cutting end face 11 can thus be viewed from the outside. According to the invention, a composite cutting end face 11 is provided comprising parts of stainless steel and parts of stainless steel with increased hardness, at least one of which extends along the cutting edge. This hardened cutting edge comes first in contact with the lamellae and has the necessary hardness to substantially prevent wear of the blade while providing a sharp cut. Since the rest of the open running end face 11 of the cutter leg is made of normal stainless steel (having lower hardness) the total hardness balance is reduced with respect to an open running end face 11 of the cutter leg having high hardness throughout. This leads to substantially less wear of the shaver cap lamellae. Indeed, over the entire lifetime of the shaver cap, it will come into contact with much less surface area of hardened steel. Surprisingly, the presence of stainless steel of lower than conventional hardness in the open running end face 11 of the cutter leg does not necessarily lead to more wear of the cutting element. Conventional hardness is usually around 600 HV1.

With a cutting element is meant an individual working shaver blade or a shaver blade that works in cooperation with another shaver blade. Such a construction of cooperating shaver blades can for instance be found in a shaver with an internal rotating cutting element that is surrounded by an external counter cutting element (cap) that has a stationary position. Both the internal rotating cutting element and the external stationary counter-cutting element are referred to in this document as cutting elements. The invention is not limited to rotary shavers. It also applies to other types of shaver, such as so-called vibra shavers for instance. In a vibra shaver, the cutting elements make an alternating translational movement with respect to a substantially stationary metal foil, for instance made of hard nickel. The cutting elements are positioned more or less perpendicular to the metal foil surface. Both sides of the cutting end face of the cutting elements therefore act as cutting edge.

A preferred embodiment of the cutting element according to the invention is characterized in that the peripheral edge 14 surrounding the open running end face 11 of the cutter leg extends over substantially the entire circumference of the running end face. Not only is such embodiment stronger but also the amount of hardened steel in the end face may more easily be increased which adds flexibility in tuning the hardness balance.

In a further preferred embodiment of the cutting element according to the invention, the thickness of the peripheral edge 14 surrounding the open running end face 11 of the cutter element 10 is adjusted such that the lifetime of the cutting element and/or shaver cap laminae is maximized. According to the invention the lifetime of the cutting elements and/or the shaver cap can actually be tuned by changing the geometric amount in the open running end face 11 of the cutter element 10 of hardened steel and less hard steel. When the cutting element wears too fast with respect to the cap, the amount of hardened steel will generally be increased. When the cap wears faster, the amount of hardened steel will generally be lowered. The optimal hardness balance can readily be determined by the person skilled in the art by trial and error experiments.

Although the ratio of the hardened peripheral edge 14 with respect to the total end facial surface area 11 of the open running end face 11 of the cutter element 10 can be varied within large ranges, preferably the hardened peripheral edge 14 of the cutting element ranges from 5 to 50% of the total end facial surface area of the open running end face 11 of the cutter element 10, even more preferably from 10 to 35% of the total end facial surface area 11, and most preferably from 15 to 25% of the total end facial surface area of the open running end face 11 of the cutter leg.

The thickness of the hardened peripheral edge 14 of the open running end face 11 generally depends on the dimensions of the open running end face 11 of the cutter leg. For rotating cutting elements with typical thicknesses of about 100 to 200 μm, the hardened surface layer 14 thickness typically ranges from 5 to 20 μm, although smaller or larger thicknesses may be suitable. A too large thickness may cause premature rupture of the cutting element, and in particular separation of the hardened peripheral edge 14 of the open running end face 11 from the rest of the element. This is believed to be due to build up of internal stresses while producing the hardened layer.

An additional advantage of the cutting element according to the invention is that it may in principle be manufactured from any type of stainless steel. Surprisingly even rather soft steels may be used. Suitable steels include maraging and/or precipitation hardenable stainless steel or austenitic stainless steel. Preferably the hardness of the stainless steel out of which the cutting element is formed ranges from 100 to 600 HV1, and more preferably from 150 to 350 HV1. The possibility of using rather soft stainless steels offers many advantages in manufacturing the cutting elements. It becomes for instance possible to make the cutting element according to the invention from injection mouldable stainless steel by a powder metallurgical method, which is a preferred method in the context of the invention. It also becomes possible to use metal forming processes in shaping the cutting elements, such as for instance deep drawing. In case of the preferred embodiment of forming the cutting element by metal injection moulding, commercially available steel qualities should preferably be selected such that they meet the corrosion resistance demand and to some extent the hardness demand. A particularly preferred steel in this context comprises a medium hardenable precipitation-hardening stainless steel known as "17-4PH". Yet the hardenability of this steel is limited to just 400 HV1 while the cutting elements of the known rota-cutter for instance generally require a hardness of 600 HV1 or higher. Application tests run with metal injection moulded cutters of 17-4PH steel (with the limited hardness of 400 HV1) showed a factor 2 too high wear rate regarding lifetime of the cutter. The invention offers a solution to this problem, in the sense that excellent formability is combined with adjustable wear and self-sharpening characteristics.

To obtain the necessary hardness for good cutting the hardness of the peripheral edge 14 is preferably at least 1000 HV1, more preferably at least 1300 HV1. Preferably, the hardness of the surface layer is at least equal to the hardness of the cap, in particular the hardness of the cap lamellae. The cutting element can be designed for use in a shaver of the dry shaver type or for use in a shaver of the additive shaver type.

The invention also relates to an electric shaver provided with a cutting element as disclosed. Such a shaver has the advantages as already mentioned in relation to the cutting element according the invention.

The invention also provides a method for producing a cutting element according to the invention. The method is characterized in that a cutting element is formed of stainless steel, and at least part of the surface of the cutting element is hardened by subjecting it to a plasma of suitable ions, with the exception of the cutting end face. Partial hardening of the cutting element however may be performed by other methods, such as strain hardening, for instance by shot peening, or local thermal hardening and/or local precipitation hardening, with surface hardening heat treatment techniques such as induction hardening, laser hardening, and the like. It is also possible to combine these methods. Generally such a combination, of which the combination of strain hardening with plasma nitriding is preferred, allows to reach higher hardness values. Strain hardening is also used to manufacture razor blades having a reduced cross-section. Such types of blades are reduced in cross-section by stamping them such that they adopt a dog-bone shape, with a reduced thickness in the middle. Such rather thin blades are particularly apt to wear. The method of the invention is in particular advantageous for such types of blade or cutting element.

In another preferred method for producing the cutting element according to the invention a cutting element is formed of stainless steel, at least part of the surface of the cutting element is hardened by subjecting it to a plasma of suitable ions, where after part of the element is removed thus forming the cutting end face.

In all methods described the ions are preferably selected from nitrogen, carbon, borium or combinations thereof. According to the invention a cutting element is for instance formed from stainless maraging steel, after the forming of which the cutting element is hardened on the surfaces concerned by means of plasma nitriding to a hardness of the top layer of at least 1300 HV1. Typical nitriding parameters include a temperature of 300° C. to 500° C., a processing time of 5 to 40 hours, and nitriding pressures of 250 Pa to 550 Pa, eventually using a pulsed plasma process. The method according the invention enables the manufacture of shaver components out of unhardened (austenitic) stainless steel, which components are hardened later in the production process by inward growth of a hard and wear resistant compound top layer, thus simplifying the production process. The unhardened stainless steel can be processed relatively easy, in particular by using metal forming techniques. According to the present invention the invented method makes it possible to use hitherto unsuitable (and relatively inexpensive) types of steel for producing the cutting element according the invention. The cutting element is hardened by plasma nitriding preferably on all surfaces of the blade, and a plasma nitriding hardened layer consisting of a surface compound top layer of steel supersaturated with nitrogen is formed, possibly with a so-called intermediate diffusion layer adjoining the top layer with a hardness ranging from the hardness of the top layer to the hardness of the steel before hardening. The advantage of the presence of the diffusion layer is that it additionally strengthens the base material and supports the load bearing capacity of the compound layer. Said surface compound layer having preferably a hardness of at least 1300 HV1 and in case of austenitic stainless steel at least 1100 HV1 is then removed at one end of the produced cutting element, to form the cutting end face.

BRIEF DESCRIPTION OF THE DRAWINGS

The present invention will be elucidated herein below with reference to the annexed drawings. Herein shows.

DETAILED DESCRIPTION OF THE DRAWINGS

Figure 1A:
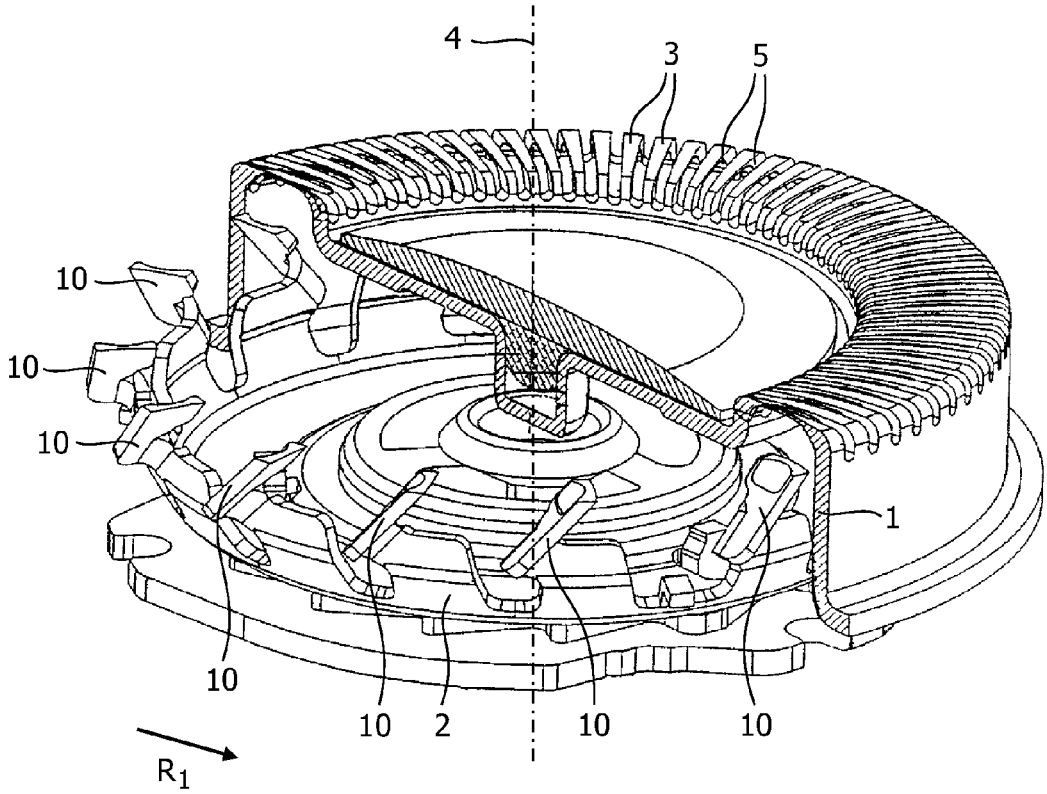
FIG. 1A a cut-away view of a shaver cap and cutting member, provided with cutting elements according to the invention.
Figure 1B:
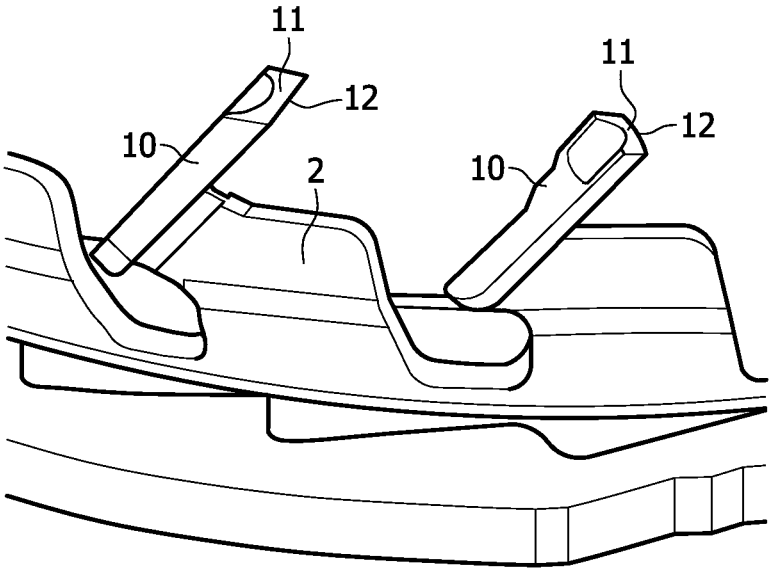
FIG. 1B a detail of the cutting member shown in FIG. 1A.

With reference to FIGS. 1A and 1B, a shaver cap member 1 is shown. Cap member 1 is provided with radially extending cap laminae 3. A cutting member 2 is rotatably arranged within cap member 1. Cutting member 2 is provided with a number of circumferentially arranged cutting elements 10, also referred to as cutter legs. When shaving, the cutting member elements 10 are rotated around axis 4 in the direction denoted by R, and entrain hairs which extend through the openings 5 between the lamellae 3 of cap member 1. In this process the cutting end faces 11 of cutter elements 10 are in frictional contact with the cap member lamellae surfaces. In the embodiment shown, cutting elements 10 are inclined with respect to the plane formed by the lamellae 3. The cutting edges, meaning those edges which come into contact with the lamellae 3 first, are denoted by 12 in FIG. 1B.

Figure 2:
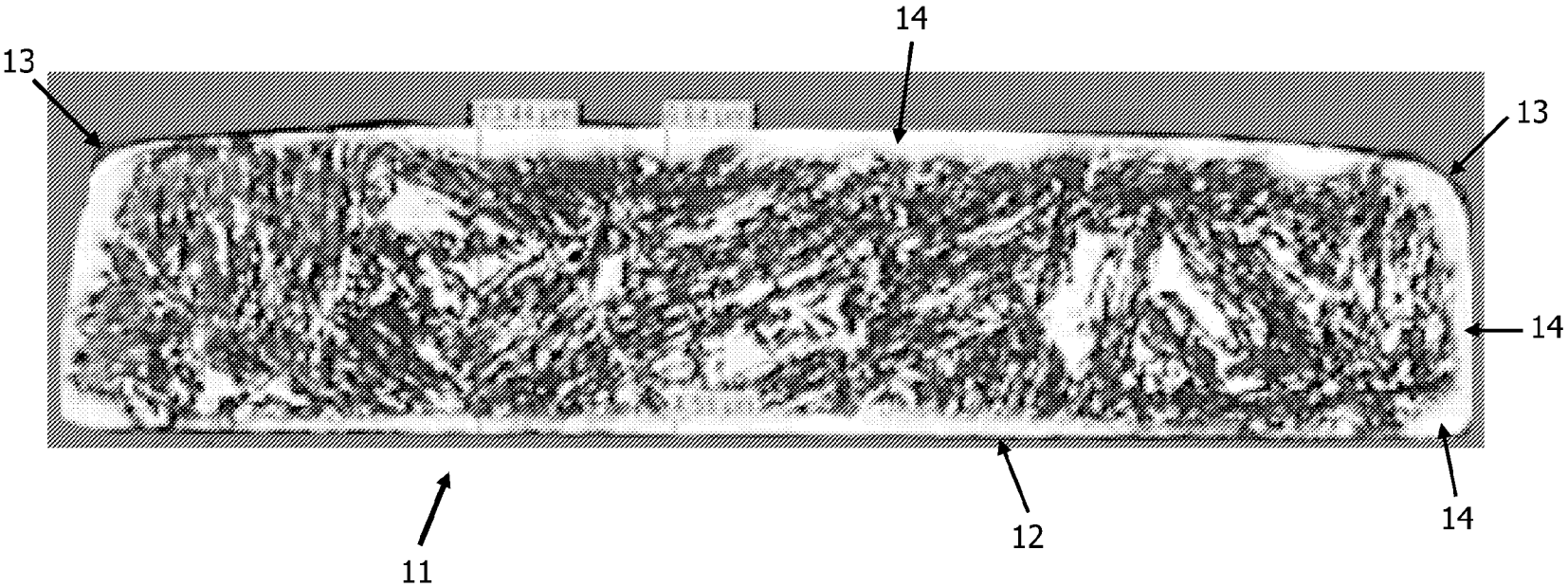
FIG. 2 a cutting end face of a cutting element according to the invention.

Referring to FIG. 2, an open running end face 11 of a cutter leg of a plasma nitrided cutting element 10 is shown. The open running end face 11 of the cutter leg is more or less rectangular shaped with rounded off corner edges 13. The lower edge 12 of the open running end face 11 of the cutter leg is the cutting edge. The open running end face 11 of the cutter element 10 comprises a hardened peripheral edge 14 covering substantially the entire circumferential surface of the open running end face 11 of the cutter leg in an even manner. The average thickness of the hardened peripheral edge 14 is about 5 μm. The open running end face 11 of the cutting element 10 is obtained by a method, wherein a cutting element is formed of stainless steel, for instance out of Sandvik 1RK91 maraging steel, according to well known practice. The total surface of the cutting element is then hardened by subjecting it to a plasma nitriding process. This can for instance be done by keeping the cutting element as produced in a pulsed nitriding furnace at 375° C. for 20 hours with 475 Pa nitrogen gas pressure, during which the nitriding takes place. With an average thickness of the cutting element of around 70 μm this results in a hardened surface layer 14 of around 5-20 μm. In the case of 1 RK91 steel the hardness of originally 500 HV1 has been increased to 1500 HV1 on the outside of the hardened peripheral edge 14. The modulus of elasticity also increases in the hardened layer, typically with 20 to 30%, for instance from 170 GPa to 220 GPa. After the cutting element has been provided with the hardened surface layer over substantially its entire surface, part of the element is removed thus forming (exposing) the cutting end face 11. The process of forming the end face 11 may comprise providing a strip of stainless steel, forming the strip to a bended shape, and grinding away part of one end section thereof at an angle with the axial direction of the cutting element (which is curved due to the bended shape). Grinding or taking away of material is preferably performed by electrical discharge machining.

Figure 3:
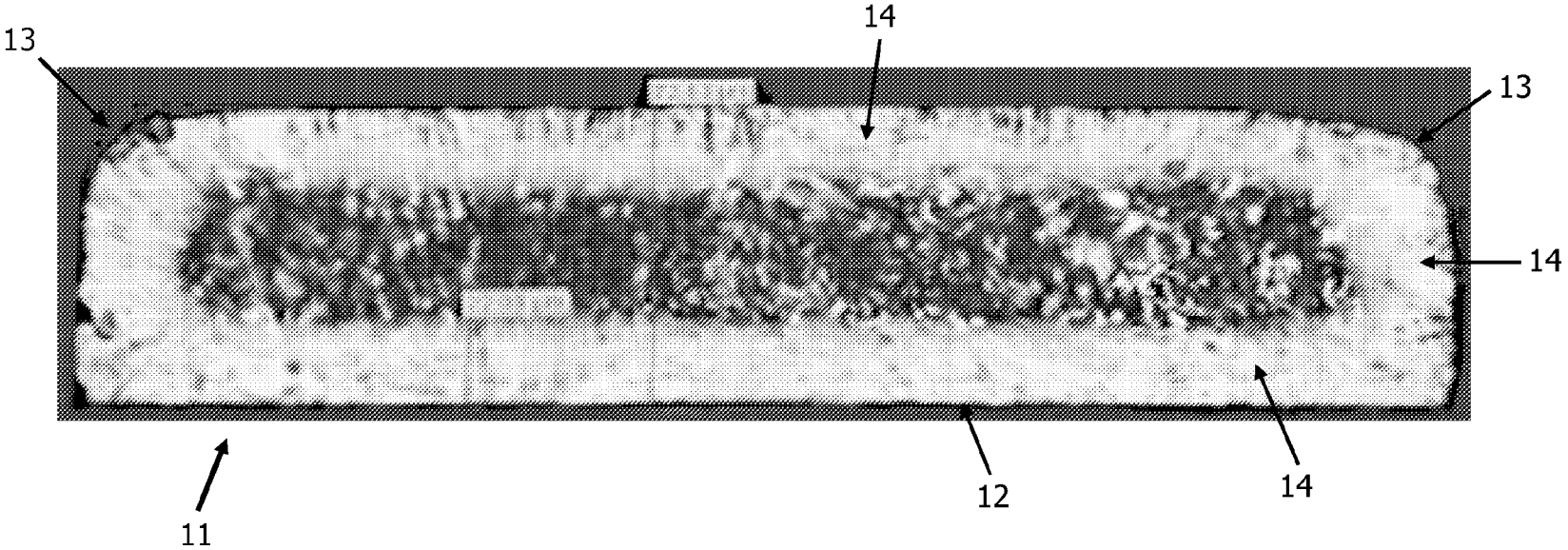
FIG. 3 a cutting end face of another cutting element according to the invention.

Depending on the particular set of parameters used in hardening several thicknesses of the hardened surface layer 14 can be formed. This is shown in FIG. 3, where a different end face 11 is depicted, having on average a thicker hardened layer 14. Such an end face 11 will generally have a hardness balance in favour of the cutting element, at the expense of the cap lamellae. Prior to the nitriding process the maraging and precipitation hardenable steels may first be hardened by an ageing heat treatment, and/or a precipitation-hardening step. Optionally this can be combined with the nitriding process. The plasma nitriding process employed here is commonly known in the art.

The method according to the invention can obviously also be employed to other devices that are subjected to high wear and corrosive conditions, such as, but not limited to, razors, rotating knives, cutting tools, certain automotive parts etc.

The invention claimed is:

1. An internal rotating cutting member for use in an electric shaver comprising:

a plurality of cutting legs, wherein each cutting leg comprises a single cutting end face having a peripheral edge surrounding the cutting end face, wherein an outer front edge of the peripheral edge at a front side of a cutting leg with respect to a rotation direction of the cutting leg is a cutting edge, wherein said cutting member is made from stainless steel, wherein the cutting end face comprises a hardened surface layer of hardened steel at least over the cutting edge, and wherein an end facial surface area of the hardened surface layer ranges from 5 to 50% of a total end facial surface area of the cutting end face.

2. The internal rotating cutting member as claimed in claim 1, wherein the hardened surface layer of the end face extends over the peripheral edge of the end face.

3. The internal rotating cutting member as claimed in claim 1, wherein a thickness of the hardened surface layer is adjusted such that a member lifetime of the cutting member and/or shaver cap lamina, with which the cutting member engages, is maximized.

4. The internal rotating cutting member as claimed in claim 1, wherein the end facial surface area of the hardened surface layer ranges from 10 to 35% of the total end facial surface area.

5. The internal rotating cutting member as claimed in claim 1, wherein a hardness of the stainless steel ranges from 100 to 600 HV1.

6. The internal rotating cutting member as claimed in claim 5, wherein the hardness of the stainless steel ranges from 150 to 350 HV1.

7. The internal rotating cutting member as claimed in claim 1, wherein a hardness of the hardened surface layer is at least 1000 HV1.

8. The internal rotating cutting member as claimed in claim 1, wherein the cutting member is made from injection moldable stainless steel by a powder metallurgical method.

9. A shaver of the dry shaver type comprising the cutting member as claimed in claim 1.

10. A shaver of the additive shaver type comprising the cutting member as claimed in claim 1.

11. An electric shaver comprising at least one cutting member as claimed in claim 1.

* * * * *